US007691340B2

(12) United States Patent
Sinha et al.

(10) Patent No.: US 7,691,340 B2
(45) Date of Patent: Apr. 6, 2010

(54) CATALYTIC CONVERTER

(75) Inventors: Satyadeo Sinha, Canton, MI (US); Charles Porter, Howell, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 476 days.

(21) Appl. No.: 11/464,967

(22) Filed: Aug. 16, 2006

(65) Prior Publication Data

US 2008/0041042 A1 Feb. 21, 2008

(51) Int. Cl.
*B01D 50/00* (2006.01)

(52) U.S. Cl. ..... 422/172; 422/168

(58) Field of Classification Search ..... 422/168, 422/177, 172, 174, 180; 60/299, 301
See application file for complete search history.

(56) References Cited

U.S. PATENT DOCUMENTS 4,278,639 A 7/1981 Tadokoro et al.
2006/0024215 A1* 2/2006 Kroner et al. ..... 422/179
2006/0171865 A1* 8/2006 Quackenbush ..... 422/168

* cited by examiner

*Primary Examiner*—Tom Duong

(57) ABSTRACT

A catalytic converter having a pair of catalytic converter members disposed in a housing. A pair of catalytic converter members is disposed within the housing along a longitudinal axis of the housing. A annular structure is disposed within the housing between the pair of catalytic converter members, such annular structure having a hollow inner region disposed along the longitudinal axis to enable exhaust gases introduced into the housing to pass from a frontal one of the pair of catalytic converter members, though the hollow region of the annular structure, to a rearward one of the pair of catalytic converter members. The annular structure terminates at a front edge and rear edge. The front edge engages a rear, outer peripheral portion of the frontal one of pair of catalytic converter members and the rear edge engages a frontal, outer peripheral portion of the rearward one of the pair of catalytic converter members.

4 Claims, 3 Drawing Sheets

CATALYTIC CONVERTER

TECHNICAL FIELD

This invention relates generally to catalytic converters and more particularly to catalytic converters having oxygen sensors.

BACKGROUND

As is known in the art, current production automotive vehicles have internal combustion engines that have catalytic converters to reduce emissions of regulated gases. The regulated gases include hydrocarbons, carbon monoxide, and oxides of nitrogen. The catalytic converter contains various catalysts that react with the exhaust gases to convert them into other gases.

One catalytic converter is described in U.S. Pat. No. 4,278,639 issued Jul. 14, 1981, inventors Tadokoro et al. Such patent describes a catalytic converter having a pair of catalytic members (i.e., a front member and a rear member) with an annular spacer ring therebetween. Exhaust gases pass from the front member through the hollow portion of the ring and then through the rear member. An oxygen sensor is disposed in the hollow portion of the hollow annular ring for measuring the amount of oxygen in the exhaust. The spacer ring has tabs or pawls that projected within the hollow portion of the ring to abut and contact the surfaces of the pair of catalytic members and thereby hold the catalyst members in alignment with the longitudinal axis of the catalytic converter.

SUMMARY

In accordance with the present invention, a catalytic converter includes a housing having disposed therein a pair of catalytic converter members. A pair of catalytic converter members is disposed within the housing along a longitudinal axis of the housing. An annular structure is disposed within the housing between the pair of catalytic converter members, such annular structure having a hollow inner region disposed along the longitudinal axis to enable exhaust gases introduced into the housing to pass along the direction of the longitudinal axis from a frontal one of the pair of catalytic converter members, through the hollow region of the annular structure, to a rearward one of the pair of catalytic converter members. The annular structure terminates at a front edge and rear edge. The front edge engages a rear, outer peripheral portion of the frontal one of pair of catalytic converter members and the rear edge engages a frontal, outer peripheral portion of the rearward one of the pair of catalytic converter members.

In one embodiment, the catalytic converter includes a one piece thermally insulating support member disposed between: an inner surface of the housing; and both the outer surface of the annular structure and outer surface portions of the pair of catalytic converter members, The inventor recognized that the tabs when in contact with the front and the rear substrates would block the passage of the exhaust gases through both substrates. This reduces the catalytic action. In accordance with the invention, the hollow ring has edges transverse its longitudinal axis, such edges engaging outer portions of the catalytic members removing the requirement of the tabs so that the amount of the catalytic members covered by the edge thickness is negligible particularly since the exhaust gas velocity adjacent to the inside wall of a ring is very small or close to zero, so the partial blockage of the catalytic member by the edge thickness of the middle piece has negligible or no effect on the catalytic action. Further, the reduction in gas flow through the tabs creates back pressure (flow resistance) in the exhaust system. This flow resistance reduces the engine efficiency. In accordance with the present invention, there is negligible or no effect on the engine efficiency. Still further, the absence of tabs in the middle piece reduces manufacturing costs since extra steps in tooling and manufacturing are eliminated.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
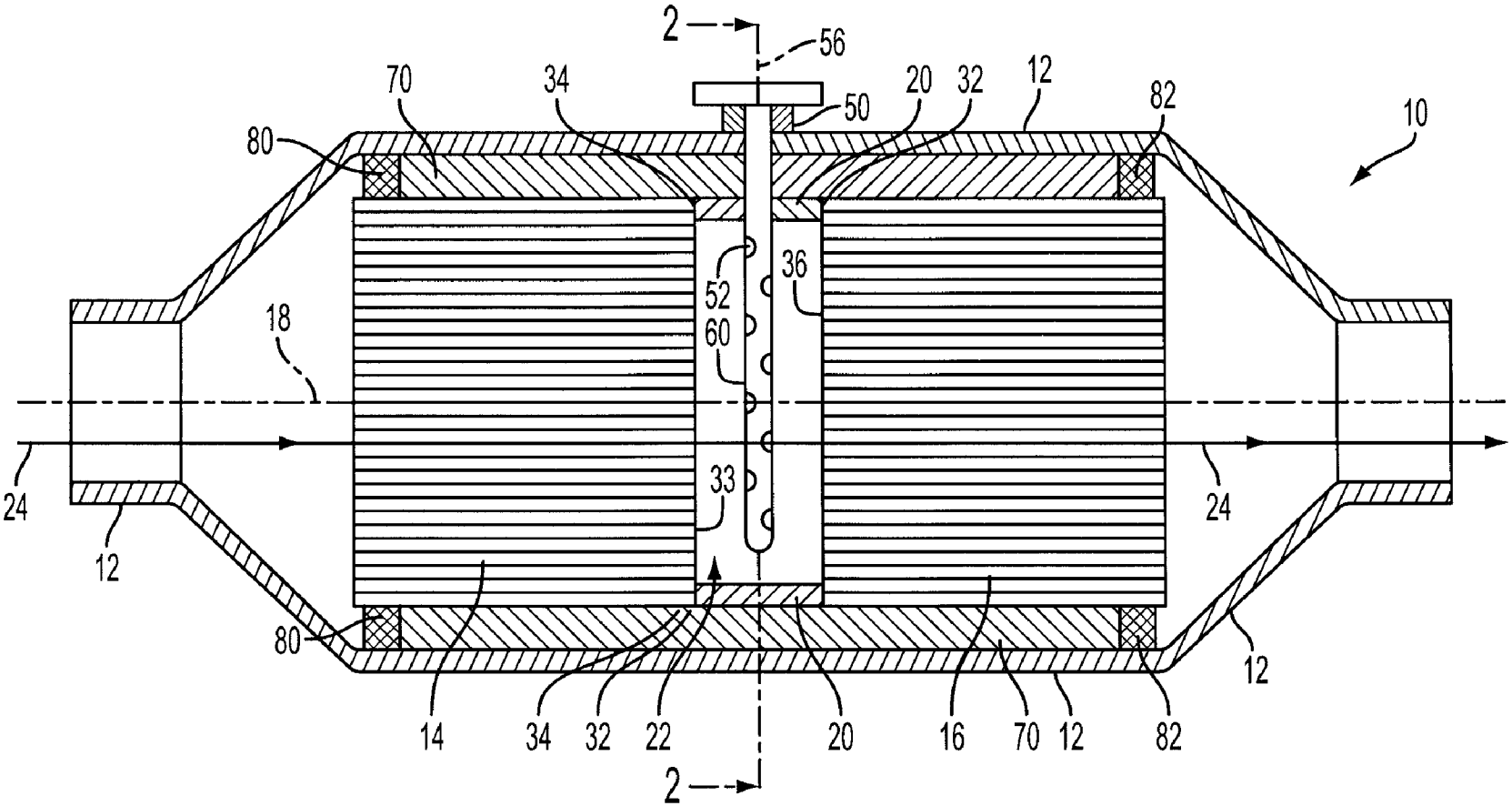
FIG. 1 is a cross sectional view of a catalytic converter according to the invention.
Figure 3:
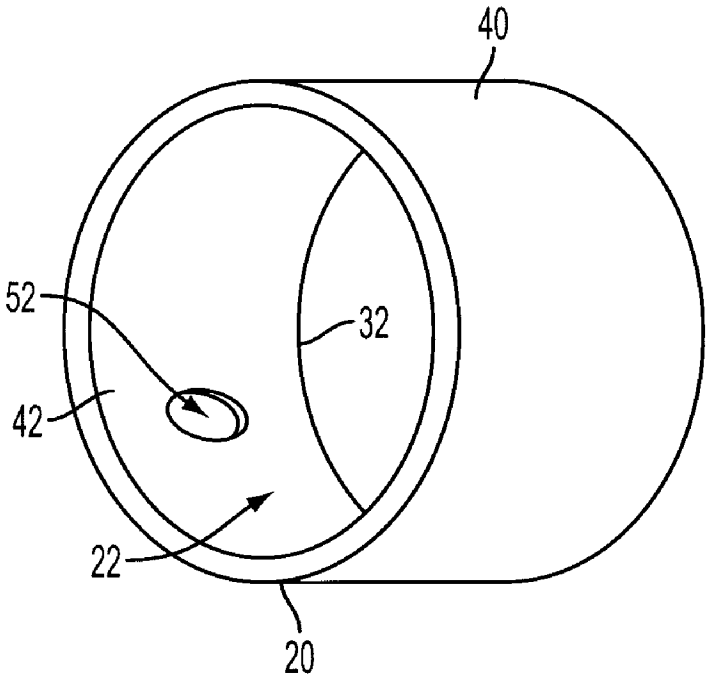
FIG. 3 is an isometric view of an annular structure used in the catalytic converter of FIG. 1.
Figure 2:
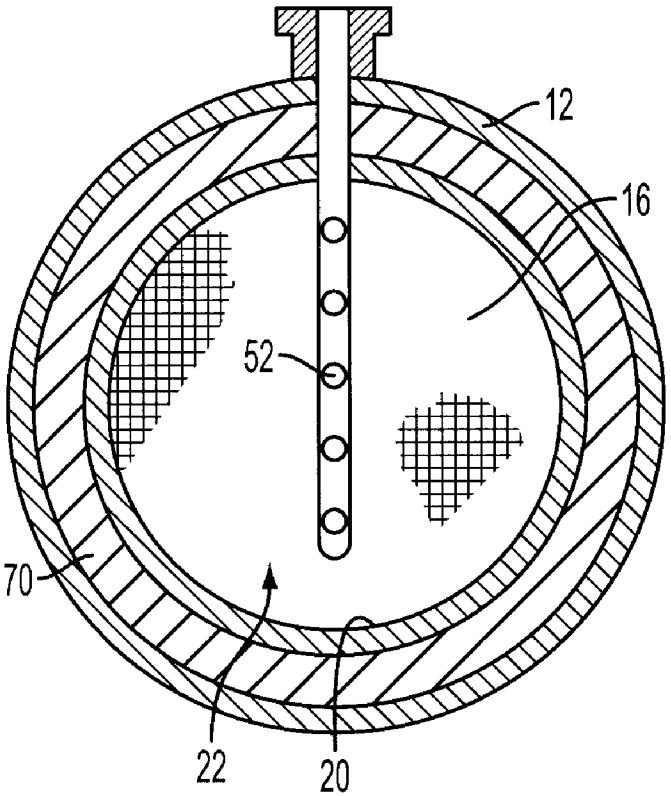
FIG. 2 is a cross sectional view of the catalytic converter of FIG. 1, such cross section being taken along line 2-2 of FIG. 1.
Figure 4:
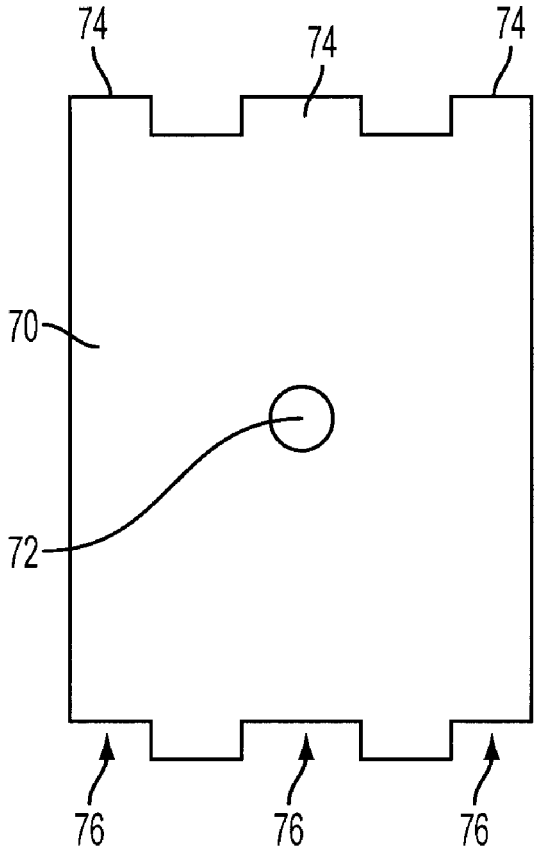
FIG. 4 is a plan view of an insulating support member for use in the catalytic converter of FIG. 1.
Figure 5:
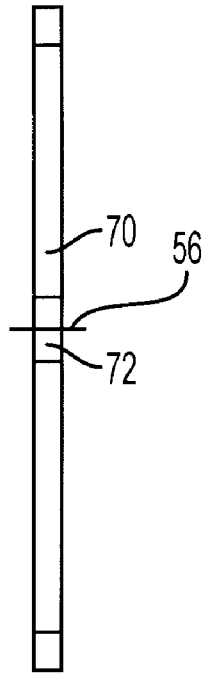
FIG. 5 is a side elevation view of the insulating support member of FIG. 4.

Referring now to FIGS. 1, 2, 3 4 and 5, a catalytic converter 10 is shown having a housing 12; a pair of catalytic converter members 14, 16 disposed within the housing 12 along a longitudinal axis 18 of the housing 12; an annular structure (spacer) 20 disposed within the housing 12 between the pair of catalytic converter members 14. 16, such annular structure 20 having a hollow inner region disposed along the longitudinal axis 18 to enable exhaust gases indicated by arrow 24 introduced into the housing 12 to pass along the direction of the longitudinal axis 18 from a frontal one of the pair of catalytic converter members 14, though the hollow region 22 of the annular structure 20, to a rearward one of the pair of catalytic converter members 16.

The catalytic converter members 14, 16 are here separate matrices, or bricks as they are sometimes called. By way of example, these bricks have the form of a ceramic honeycomb structure. Particles of a catalyst, usually platinum, are embedded in the surface of the matrix, the design of the matrix being intended to maximize the surface area over which the catalytic reaction takes place as, for example, described in U.S. Pat. No. 5,465,574 issued Nov. 14, 1995, inventor Ma, assigned to the same assignee as the present invention.

The annular structure 20 terminates at a front edge 34 and rear edge 32. The front edge 34 engages a rear, outer peripheral portion 33 of the frontal one of pair of catalytic converter members 12 and the rear edge 32 engages a frontal, outer peripheral portion 36 of the rearward one of the pair of catalytic converter members 16. Thus, the annular structure 20 has the front edge 34 disposed transverse to the longitudinal axis 18 and the rear edge 32 disposed traverse the longitudinal axis 18, such front edge 34 and rear edge 32 extending between the outer surface 40 and the inner surface 42 of the structure 20, the front edge 34 and rear edge 32 engaging outer peripheral portions of the catalytic converter members as described above. The annular structure 20 may be, for example, 300 series stainless steel, 400 series stainless steel, or any high temperature metal alloy with good oxidation and corrosion resistance characteristics. Here, the, for example, thickness of the annular structure is nominally 0.065 inches.

The housing 12 and annular structure 20 have apertures 50. 52 through them, such apertures being in registration with each other and being disposed along an axis 56 perpendicular to the longitudinal axis 18. An oxygen sensor 60 is disposed through the apertures 50, 52 and projects into the hollow region 22 of the annular structure 20 for measuring the amount of oxygen in the exhaust.

The catalytic converter 10 includes a one-piece thermally insulating support member 70 deposed between: an inner surface of the housing 12; and both the outer surface 40 of the annular structure 20 and outer surface portions of the pair of catalytic converter members 14, 16. The support member 70 has an aperture 72 in registration with apertures 52, 52 to enable the oxygen sensor 60 to pass through to region 22. This one-piece support member 70 or mat retains the catalytic converter members 14, 16 and the annular structure 20 in place and not allow the catalytic converter members 14, 16 to move inside the catalytic converter housing 12. Another purpose of this mat is to act as a thermal insulator between the catalytic converter members 14, 16 and the housing 12. Yet another purpose of this mat 70 is to improve NVH (Noise/Vibration/Harshness) characteristics of the catalytic converter 10. It is usually made of ceramic fibers, is flexible and pliable, and can be an expandable or non-expandable mat 70 depending on the formulation of the mat 70. This part provides thermal insulation. More particularly, the mat 70 wraps around the pair of catalytic members 14, 16 and the annular member 20 with outer taps 72 being inserted into opposing slots 76 of the one-piece member 70. To hold the mat 70 to the pair of catalytic members 14, 16 and the annular member 20, a piece of paper masking tape, not shown, is used to temporarily hold the mat 70 and the wrapped pair of catalytic members 14, 16 and the annular member 20 to form an assembly. The assembly is then slid into the housing 12. Heat generated by the gases harmlessly consumes the paper masking tape.

A pair of annular end caps 80, 82, here of a metal wire mesh material, may be disposed within the housing 12 at front and rear edges of the one-piece member 70 to protect its edges for erosion in certain applications. The assembly operation is as follows:

(1) Design and manufacture the annular structure (spacer) 20 and drill the hole 52 for mounting the oxygen sensor 60.

(2) Position the two catalytic converter members 14, 16 with the spacer 20 in between in contact with each other. (All three components 14, 16 and 20 should be in contact with each other, no space in between).

(3) Matching the hole for the sensor 60 on the support member 70 with the hole 52, wrap the three components 14, 16 and 20 inside the single support member 70.

(4) Tape the ends of the support member 70 with a masking tape, not shown, securing all three components 14, 16 and 20 inside the single support member 70 to thereby form a sub-assembly.

(5) Insert this sub-assembly into the housing 12 and perform the swaging operation wherein the dressed substrate with the support mat wrapped around it is inserted inside the outer shell tube and then the tube outside diameter is reduced by an eight-finger machine to give it a final outside diameter dimension or, in case of tourniquet wrap, wrap the subassembly inside the outer shell and perform tourniquet-wrapping operation wherein the dressed substrate with the support mat wrapped around it is laid on a flat piece of a sheet metal with correct rectangular geometry and the flat sheet metal is then wrapped around the dressed substrate to form the outer shell. At the joining ends of the rectangular sheet metal, an optional overlap of the ends is sometimes created where weld is applied to secure the internals.

It is noted that by choosing the proper geometry and configuration of the middle section 20, other converter canning can be performed which are commonly known in the converter business as "Clam Shell" and "Shoe Box" converter designs.

A number of embodiments of the invention have been described. Nevertheless, it will be understood that various modifications may be made without departing from the spirit and scope of the invention. It should be noted that the geometry, especially the cross section contour of the center piece 20 can be changed to match with the cross section contour of the substrates 14, 16. This contour, in addition to being circular, can also be oval or a racetrack configuration (i.e., like an elongated oval), depending on the shape of the housing 12. Other embodiments include different types of materials for treating exhaust gases such as diesel particulate filters. Accordingly, other embodiments are within the scope of the following claims.

What is claimed is:

1. A catalytic converter, comprising;

a housing;

a pair of catalytic converter members disposed within the housing along a longitudinal axis of the housing;

an annular structure disposed within the housing between the pair of catalytic converter members, such annular structure having a hollow inner region disposed along the longitudinal axis to enable exhaust gases introduced into the housing to pass along the direction of the longitudinal axis from a frontal one of the pair of catalytic converter members, though the hollow region of the annular structure, to a rearward one of the pair of catalytic converter members;

wherein the annular structure terminates at a front edge and rear edge;

wherein the front edge engages a rear, outer peripheral portion of the frontal one of pair of catalytic converter members and the rear edge engages a frontal, outer peripheral portion of the rearward one of the pair of catalytic converter members; and a one piece thermally insulating support member disposed between: an inner surface of the housing; and both the outer surface of the annular structure and outer surface portions of the pair of catalytic converter members.

2. The catalytic converter recited in claim 1 wherein the front edge contact a rear, outer peripheral portion of the frontal one of pair of catalytic converter members and the rear edge contact a frontal, outer peripheral portion of the rearward one of the pair of catalytic converter members.

3. A catalytic converter, comprising:

a housing;

a pair of catalytic converter members disposed within the housing along a longitudinal axis of the housing; and an annular structure disposed within the housing between the pair of catalytic converter members, such annular structure having an outer surface, an inner surface, and a hollow region bounder by the inner surface, such hollow region being disposed along the longitudinal axis to enable exhaust gases introduced into the housing to pass from a frontal one of the pair of catalytic converter members, though the hollow region of the annular structure, to a rearward one of the pair of catalytic converter members;

wherein the annular structure has a front edge disposed transverse to the longitudinal axis and a rear edge disposed traverse the longitudinal axis, such front edge and rear edge extending between the outer surface and the inner surface, such front edge and rear edge engaging outer peripheral portions of the catalytic converter members; and an one piece insulating support member disposed between; an inner surface of the housing; and both the outer surface of the annular structure and outer surface portions of the pair of catalytic converter members.

4. The catalytic converter recited in claim 3 wherein the front edge contacts a rear, outer peripheral portion of the frontal one of pair of catalytic converter members and the rear edge contacts a frontal, outer peripheral portion of the rearward one of the pair of catalytic converter members.

* * * * *